US005644117A

United States Patent [19]

Bolongeat-Mobleu et al.

[11] Patent Number: 5,644,117

[45] Date of Patent: Jul. 1, 1997

[54] MEDIUM VOLTAGE ELECTRICAL CIRCUIT BREAKER AND SWITCH

[75] Inventors: Roger Bolongeat-Mobleu; Frédéric Burnaz, both of Echirolles; Hans Schellekens, Meylan, all of France

[73] Assignee: Schneider Electric SA, France

[21] Appl. No.: 416,362

[22] Filed: Apr. 4, 1995

[30] Foreign Application Priority Data

Apr. 25, 1994 [FR] France ..... 9405071

[51] Int. Cl.[6] ..... H01H 33/42

[52] U.S. Cl. ..... 218/154

[58] Field of Search ..... 218/1–21, 45, 218/55, 67, 79, 80, 100, 152–154

[56] References Cited

U.S. PATENT DOCUMENTS

| | | | |
|---|---|---|---|
| 3,070,680 | 12/1962 | McBride et al. | 200/146 |
| 3,226,499 | 12/1965 | Curtis et al. | 200/48 |
| 3,255,332 | 6/1966 | Curtis et al. | 200/146 |
| 3,480,750 | 11/1969 | Voshall | 200/144 |
| 4,220,837 | 9/1980 | Bice | 200/146 R |

FOREIGN PATENT DOCUMENTS

| | | | |
|---|---|---|---|
| 0485306 | 10/1991 | European Pat. Off. | H01H 1/54 |
| 0517620 | 5/1992 | European Pat. Off. | H01H 33/12 |
| 1156919 | 7/1969 | United Kingdom | H01H 33/12 |
| 90/03657 | 4/1990 | WIPO | H01H 33/66 |

*Primary Examiner*—Michael L. Gellner
*Assistant Examiner*—Michael A. Friedhofer
*Attorney, Agent, or Firm*—Parkhurst, Wendel & Burr, L.L.P.

[57] ABSTRACT

A medium voltage circuit breaker and switch having first and second stationary contacts, a mobile conducting bridge equipped with first and second movable contacts, an operating mechanism coupled to said bridge. The switch further having a vacuum cartridge containing a third stationary contacts electrically connected to the second stationary contacts, a third movable contact electrically connected to said bridge, and mechanically coupled to said operating mechanism, and sequencing means designed to establish the opening and closing sequences of the first, second, and third contacts cooperating with the operating means so that in the course of opening or closing operations of the switch, the third stationary and movable contacts close momentarily to switch the arc associated with the first stationary and movable contacts or with the second stationary and movable contacts.

12 Claims, 21 Drawing Sheets f
o
f
o
f
o f
o
f
o
f
o

MEDIUM VOLTAGE ELECTRICAL CIRCUIT BREAKER AND SWITCH

BACKGROUND OF THE INVENTION

The present invention relates to a switch designed to be used as a circuit breaker as well as a medium voltage electrical switch.

A known load-break switch is described in U.S. Pat. No. 5,168,139 and comprises on the one hand a vacuum switch tube mainly comprising an insulating tubular case closed by two conducting end covers through which two coaxially opposite contact spindles pass having frontal contact faces, and on the other hand two switch contacts of the blade type, one of the breaking contacts being mounted in parallel with the vacuum switching tube, whereas the other switch contacts is mounted in series with the parallel circuit thus constituted. In operation, when the load-break switch is closed, and the two switch contacts are in a stable closed position, the vacuum interupter is kept open during operation of the switch. When the load-break switch opens, the vacuum interrupter contacts are first closed, then the parallel mounted breaking contact is opened, then the vacuum commutator contact is opened, and finally the second contacts arranged in series is opened.

However this device requires two separate control systems of the switches, which results in its dimensions being particularly large.

A multipole rotary switch is also known as described in FR 2,668,851, and which is formed mainly by a sealed revolution enclosure filled with a high dielectric strength gas, the internal circumference of the enclosure bearing, per pole, a stationary input contact, a stationary output contact and a stationary earthing contact. These contacts are spaced apart angularly and cooperate with a contact bridge in the form of a pivoting knife-blade supported by a rotary operating shaft extending in the axis of the enclosure. In this embodiment which does not use the vacuum breaking technique, the above-mentioned shaft can selectively occupy three positions, i.e. an open position, a closed position, and an earthed position.

SUMMARY OF THE INVENTION

The present invention solves the problem of creating a switch and a circuit breaker using the vacuum breaking technique which is of simple design and small dimensions.

The object of the present invention is to provide a medium voltage electrical switch comprising a sealed enclosure filled with a dielectric gas in which there are housed a first stationary contact electrically connected to a first connection terminal, a second stationary contact electrically connected to a second connection terminal, a mobile conducting bridge equipped with a first and a second movable contact designed to cooperate respectively with the first and second stationary contacts and an operating mechanism coupled to said bridge to establish or interrupt the electrical circuit between the first and second connection terminals. The switch further comprises a vacuum cartridge containing a third stationary contacts electrically connected to one, called the second, of the two connection terminals, and a third movable contact electrically connected to said bridge at an intermediate point situated between the first and second movable contacts and mechanically coupled to said operating mechanism and sequencing means designed to establish the opening and closing sequences of the first, second and third movable contacts associated to the first, second and third stationary contacts cooperating with the above-mentioned operating means, in such a way that in the stable open or closed position of the switch, the third stationary and movable contacts are separated, and that in the course of the opening or closing operations of the switch, the third stationary and movable contacts close momentarily to switch the arc associated to the first stationary and movable contacts or to the second stationary and movable contacts.

According to a particular embodiment, the bridge is rotary.

According to a particular feature, the bridge comprises two distinct opposite arms, a first arm one of whose ends is equipped with said first movable contacts and whose other end is pivotally mounted around a spindle, and a second arm one of whose ends is equipped with said second movable contacts and whose other end is pivotally mounted around said spindle.

According to another particular feature, the above-mentioned operating mechanism comprises a crank linked in rotation to a drive shaft, and a first and a second connecting rod, coupled by one of their ends to the crank and by their other end respectively to the first and second arms.

Preferably, the above-mentioned first terminal is an input terminal strip and the above-mentioned second terminal is an output terminal strip.

According to another feature, the above-mentioned sequencing means are adapted to maintain the third stationary and movable contacts separated in the stable position of the switch, and to close these two contacts in the course of opening the switch, prior to separation of the second stationary and movable contacts, and, in the course of closing the switch, after closing of the second stationary and movable contacts.

According to another feature, the sequencing means include an extended fixed terminal strip provided on the above-mentioned first stationary contact, remaining in contact with said first movable contact over a preset travel of said first movable contact, and a reduced stationary terminal strip provided on the second stationary contact and not remaining in contact with said second movable contact over a preset travel of the said second movable contact, when movement of the latter takes place.

According to another feature, the third movable contact is supported by a rod movable in translation which is biased by spring means in the opening direction of the third stationary and movable contacts, said rod cooperating with means provided on the above-mentioned arms defining the opening and closing sequencing of the above-mentioned third stationary and movable contacts.

According to a particular embodiment, the above-mentioned means comprise at least one cam securedly united to the first or second arm whose profile defines the above-mentioned sequencing.

According to an alternative embodiment, the above-mentioned means comprise an aperture arranged in one of the arms cooperating with a spigot securedly united to a connecting rod connected in articulated manner via one of its ends to the above-mentioned rod, and via its other end to a crank mounted free in rotation on the above-mentioned spindle.

According to a particular feature, the above-mentioned aperture is of arched shape and comprises a notched recess so as to form two portions of aperture of different widths.

According to another alternative embodiment, the switch comprises in addition a fourth stationary contact which is earthed, which is diametrically opposite to the second stationary contact with respect to said spindle and a fifth stationary contact electrically connected to said second terminal which is diametrically opposite to the first stationary contact with respect to said spindle, said fourth and fifth stationary contacts cooperating respectively with the first and second movable contacts in the earthed position of the switch.

BRIEF DESCRIPTION OF THE DRAWINGS

Other advantages and features of the invention will become more clearly apparent from the following description, given as non-restrictive examples only and represented in the accompanying drawings in which:

FIG. 1 illustrates the circuit breaker in the closed position.

FIG. 2 illustrates the circuit breaker in the course of opening, in the switching position of the arc associated with the second stationary and movable contacts.

FIG. 3 illustrates the circuit breaker in the course of opening, at a more advanced stage than the previous one.

FIG. 4 illustrates the circuit breaker in the fully open position.

FIG. 5 illustrates the circuit breaker in the course of closing.

FIG. 6 illustrates the circuit breaker in the course of closing, at a more advanced stage than the previous one.

FIG. 7 illustrates the circuit breaker in the course of closing, in the switching position of the arc associated to the first stationary and movable contacts.

DETAILED DESCRIPTION OF THE PREFERRED EMBODIMENT

Figure 1:
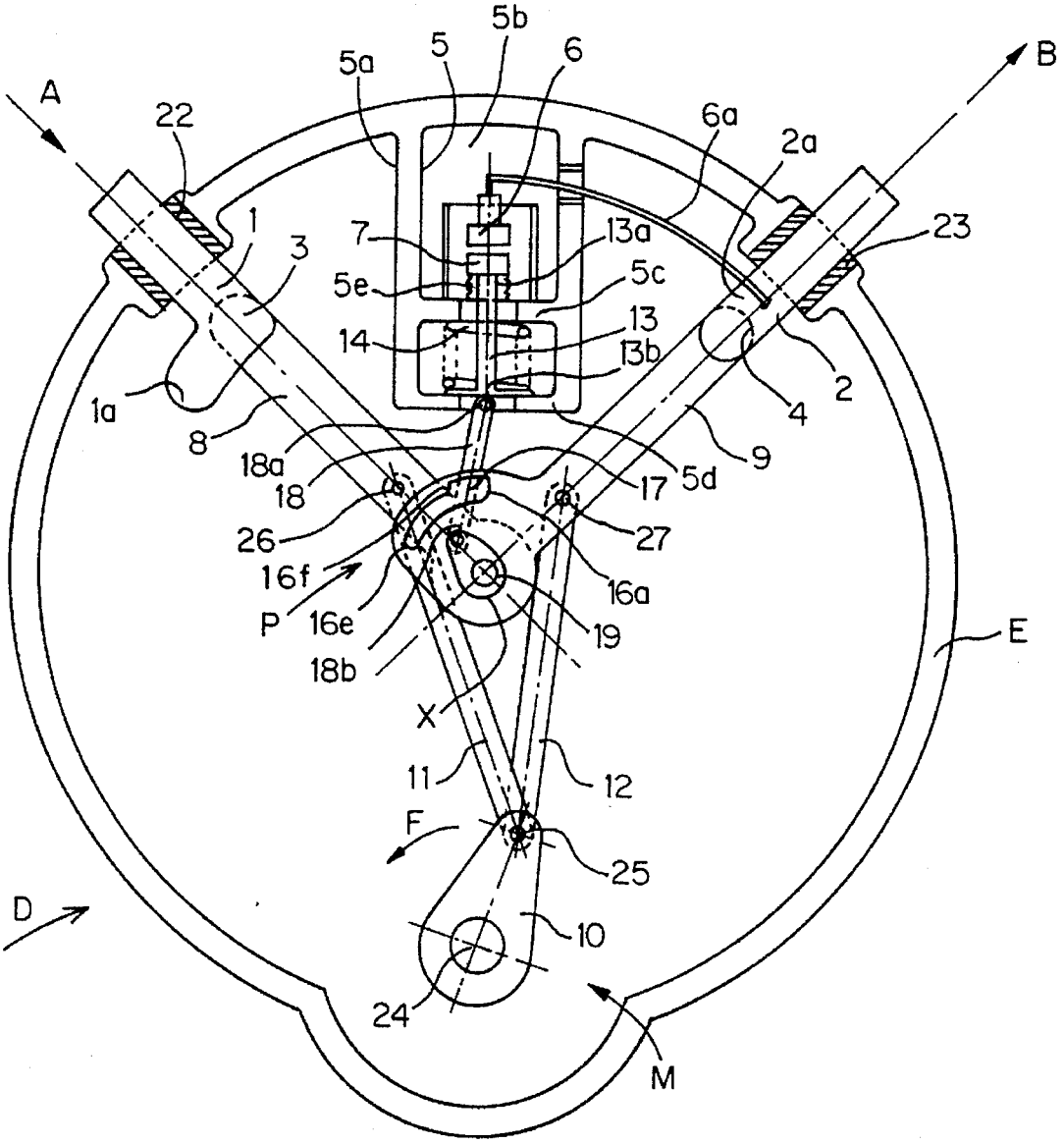
FIGS. 1 to 7 illustrate radial sectional views of a circuit breaker according to a particular embodiment of the invention, in different positions corresponding to different stages of opening and closing of the circuit breaker.

In FIGS. 1 to 7, a switch according to the invention is shown used as a medium voltage circuit breaker D and housed in a sealed enclosure E filled with a dielectric gas whose insulating wall may be that of a pole-unit or of the three pole-units of the circuit breaker D. The enclosure wall may also be made of metal. The pole-unit represented in the figures comprises two sealed bushings 22, 23, respectively of current input and output conductors, supporting a stationary input contact 1 and a stationary output contact 2 and which terminate outside the enclosure E by connection terminals A, B respectively constituting an input terminal strip and an output terminal strip.

The circuit breaker D also comprises on the one hand a movable conducting bridge P and an operating mechanism M cooperating to establish or interrupt the current between the first and second connection terminals A, B, and also a cartridge 5 comprising two contacts respectively stationary 6 and movable 7, respectively connected to the stationary output contact 2 and to the above-mentioned bridge P to switch the arc associated to the first or second stationary and movable contacts in the manner which will be explained later herein.

The above-mentioned movable conducting bridge P comprises two arms 8, 9 connected in articulated manner by one of their ends to a spindle X securedly united to the enclosure E, and whose free ends form first and second movable contacts 3, 4 designed to come into contact respectively with the above-mentioned first and second stationary contacts 1, 2 by rotation of the arms 8, 9 around the above-mentioned spindle X. This rotation of the arms 8, 9 is brought about by the operating mechanism M which is constituted mainly by a crank 10 linked in rotation with a motor shaft 24 extending parallel to the above-mentioned spindle X and by two connecting rods 11, 12 articulated by one of their ends on a spindle 25 securedly united to the above-mentioned crank 10, and by their opposite ends around two distinct spindles 26, 27 securedly united respectively to the above-mentioned two arms 8, 9.

The vacuum cartridge 5 is formed by a cylindrical wall 5*a*, for example shaped with the wall of the enclosure E and comprising a housing 5*b* receiving the two contacts respectively stationary and movable 6, 7 of the cartridge 5. The stationary contact 6 is connected by a conducting element 6*a* to the above-mentioned second stationary contact 2, whereas the movable contact 7 of the cartridge 5, called the third movable contact, is fixed to one 13*a* of the ends of a rod 13 mounted sliding through an intermediate wall 5*c* of the cartridge 5, and connected in articulated manner by its opposite end 13*b* to one 18*a* of the ends of a connecting rod 18 connected in articulated manner by its other end 18*b* to a second crank 19 mounted freely rotating around the above-mentioned central fixed spindle X. The third stationary and movable contacts 6, 7 of the vacuum cartridge 5 are permanently biased to the open position by a spring 14, interposed between the intermediate wall 5*c* and the base wall 5*d* of the cartridge 5, a sealing bellows 5*e* being fitted between the movable third contact 7 and the intermediate wall 5*c*.

The circuit breaker D of the invention also comprises suitable sequencing means to establish the opening and closing sequences of the first, second and third movable contacts 3, 4, 7, associated with the above-mentioned first, second and third stationary contacts 1, 2, 6. These means comprise an extended fixed strip l*a* formed on the first stationary contact 1, a reduced fixed strip 2*a* formed on the second stationary contact 2, and an aperture 16, of arched shape, formed by two portions of aperture 16*b*, 16*c* of different widths joined together forming a notched recess 16*f*, said aperture 16 cooperating with a spigot 17 fixed to the above-mentioned connecting rod 18 perpendicularly to its axis.

In FIGS. 9 to 14, a switch I can be seen formed in the same way as the previously described circuit breaker D, but comprising in addition a fourth stationary contact 20 connected to the earth T, and a fifth stationary contact 21 electrically connected to the previously mentioned second stationary contact 2.

In FIGS. 16 to 20, a switch I can also include a fourth stationary earthing contact 20 and a fifth stationary contact 21 electrically connected to the second stationary contact 2, which differs from the previously described switch I by the structure of the means establishing the opening and closing sequences of the third stationary and movable contact 6, 7 of the vacuum cartridge 5.

According to this alternative embodiment of the invention, the second arm 29 comprises a cam 15 designed to cooperate directly with the rod 13 to close or open the third stationary and movable contacts 6, 7.

Figures 21, 21A, 21B, 21C:
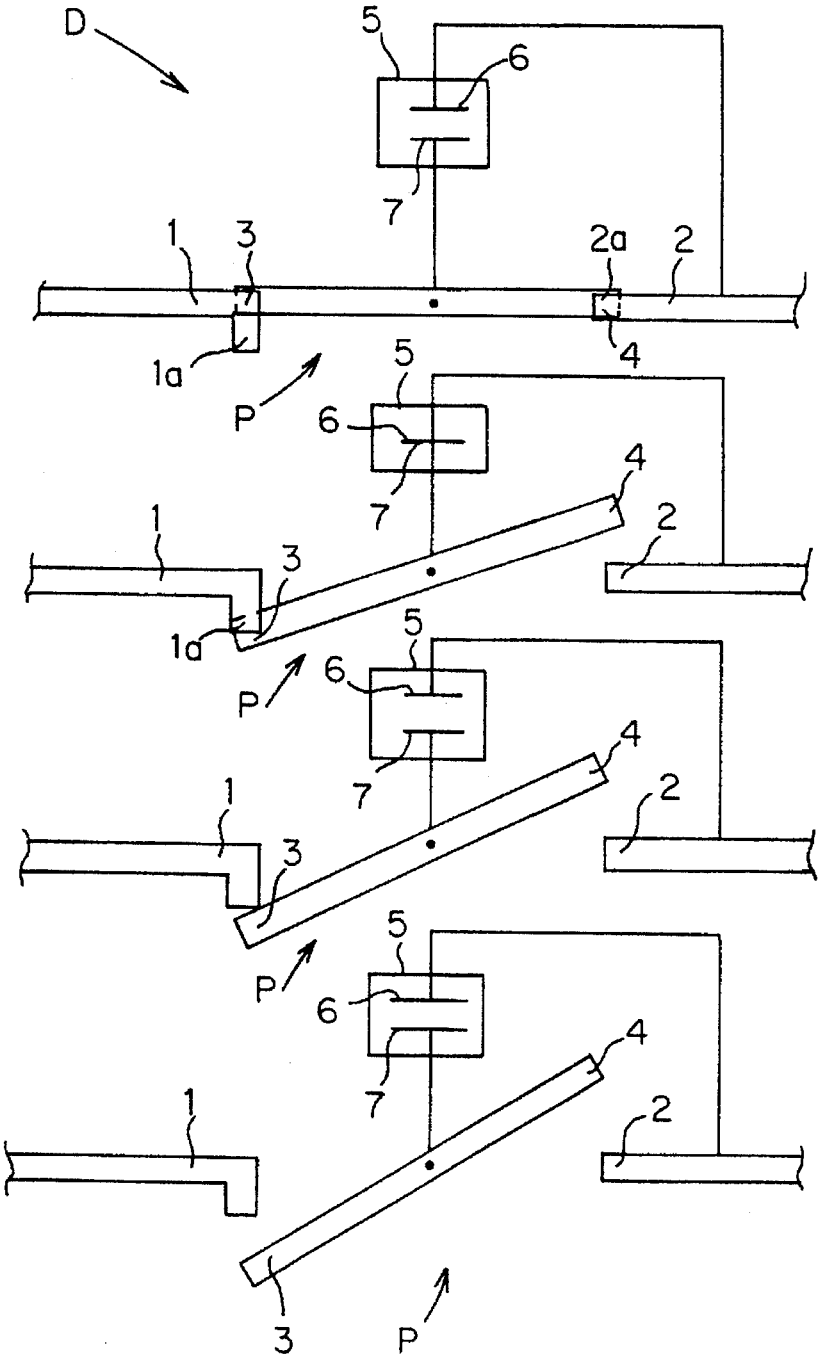
FIGS. 21 to 21*c* illustrate respectively, in schematic views, different stages of opening of a circuit breaker according to another embodiment of the invention wherein the conducting bridge is monobloc.

In FIGS. 21 to 21*c*, an embodiment of a circuit breaker D can be seen wherein a rotating monobloc conducting bridge is used to enable or interrupt flow of the current between a first stationary contact 1 presenting an extended fixed strip 1*a* and a second stationary contact 2 presenting a reduced fixed strip 2*a*. This bridge 8 is driven in rotation by an operating shaft (not represented) and is electrically connected to the movable contact 7 of a vacuum cartridge 5 whose stationary contact 6 is electrically connected to the previously mentioned second stationary contact 2.

Operation of the circuit breaker described in FIGS. 1 to 7 is kept explained with reference to FIGS. 1 to 8.

Figure 2:
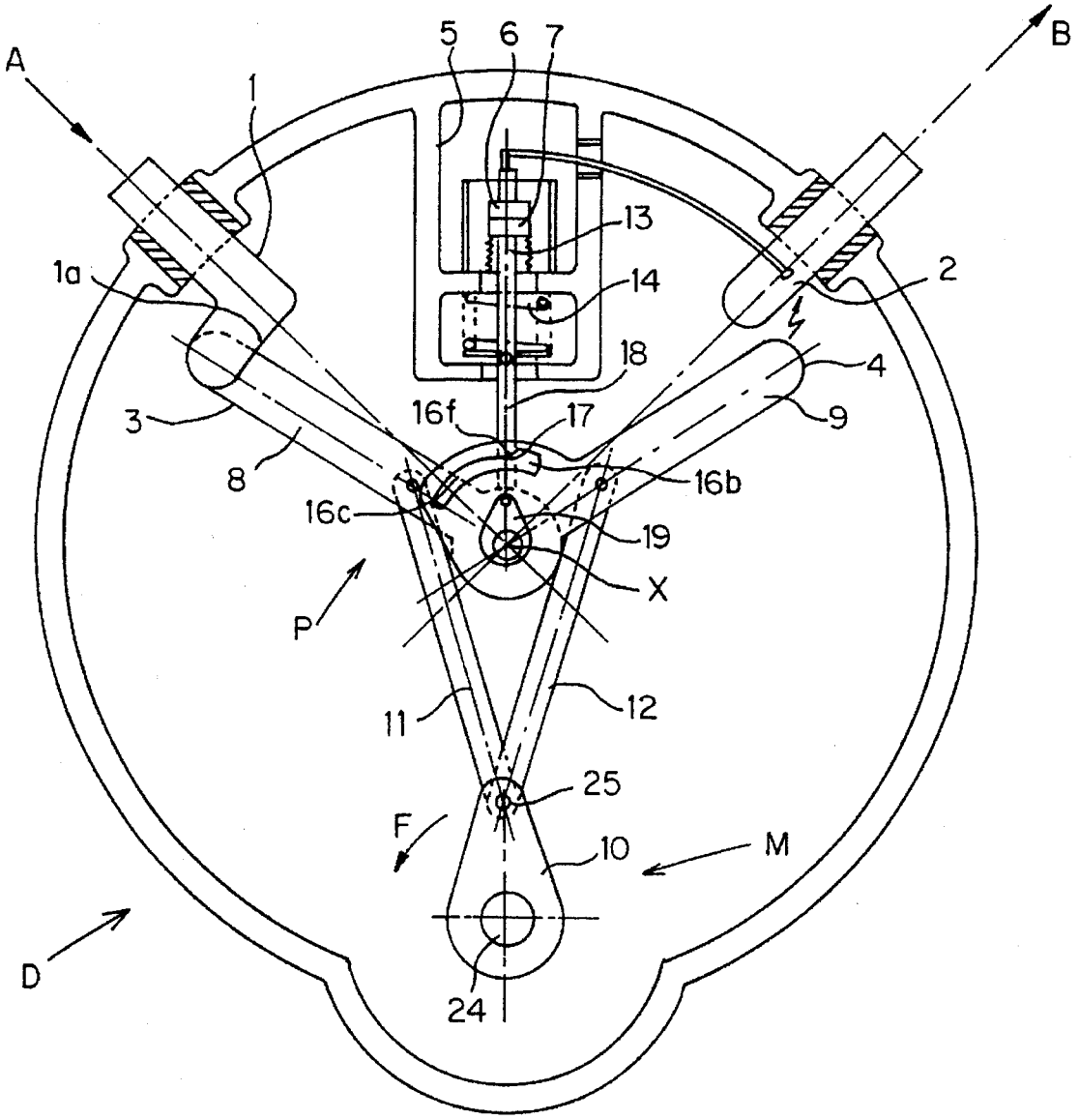

In FIG. 1, the circuit breaker D is in the closed position, the contacts between the first stationary and movable contacts 1, 3 and the second stationary and movable contacts 2, 4 are closed, thus allowing the current to flow between the input and output terminals A, B, and the contacts 6, 7 of the vacuum cartridge are open. In FIG. 2, the crank 10 has been driven in rotation by the operating shaft 24 by an angle of about 30 degrees (according to the arrow F), which has caused angular movement of the two arms 8, 9 of the conducting bridge P by a corresponding angle. During this movement, the edge forming the recess 16*f* of the aperture 16 arranged in the second arm 9 is in contact with the spigot 17 securedly united to the connecting rod 18, which causes rotation of the connecting rod 18 around the central spindle X by means of the second crank 19, and causes translation of the rod 13 towards the top of the cartridge 5 so as to close the third stationary and movable contacts 6, 7.

In this position of the conducting bridge P, the first stationary and movable contacts 1, 3 are still closed, due to the extent of the L-shaped contact strip la of the first stationary contact 1, whereas the second stationary and movable contacts 2, 4 are open after the contacts 6, 7 of the cartridge close, which results in switching of the arc onto the vacuum cartridge 5.

Figure 3:
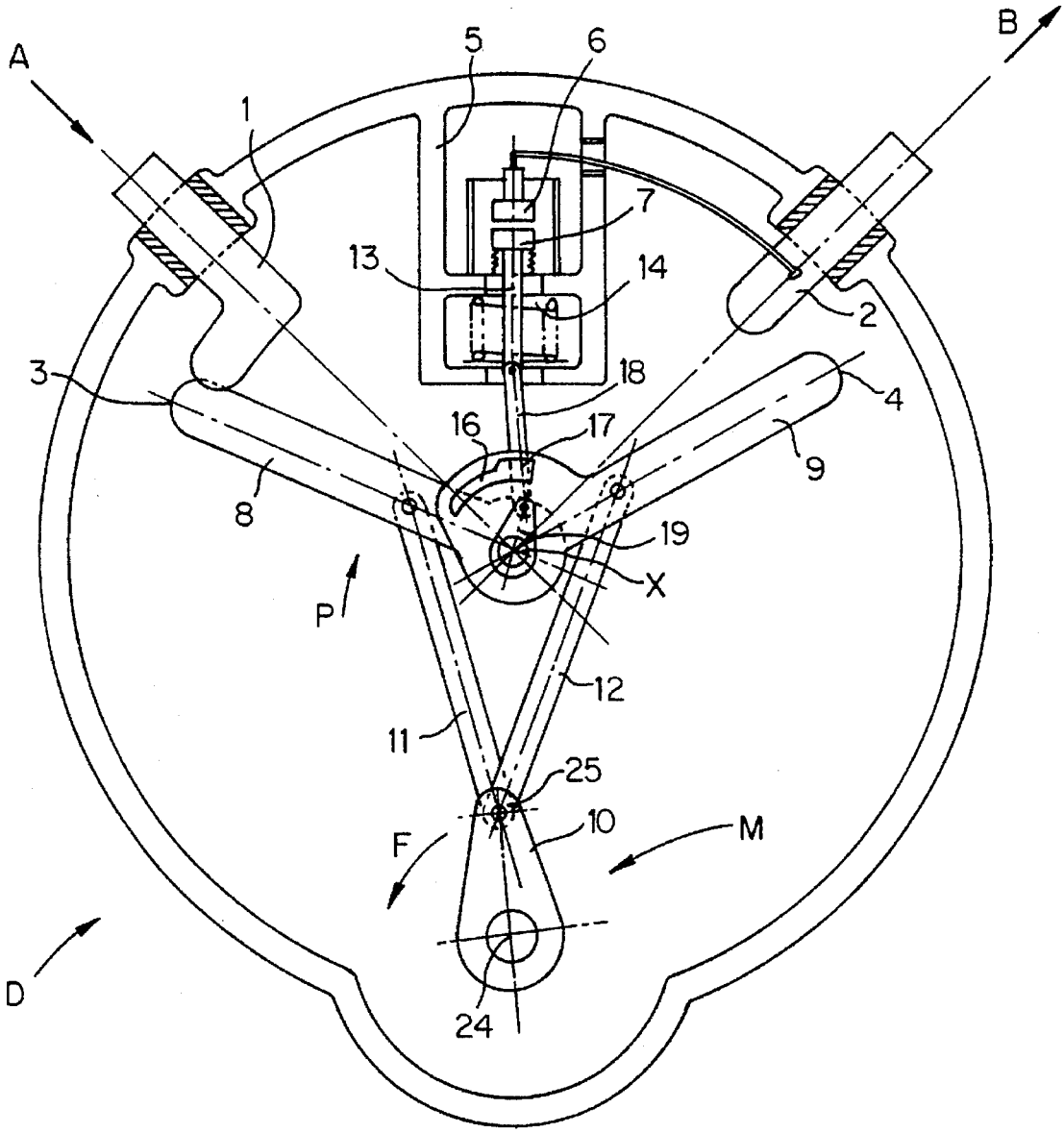
Figure 4:
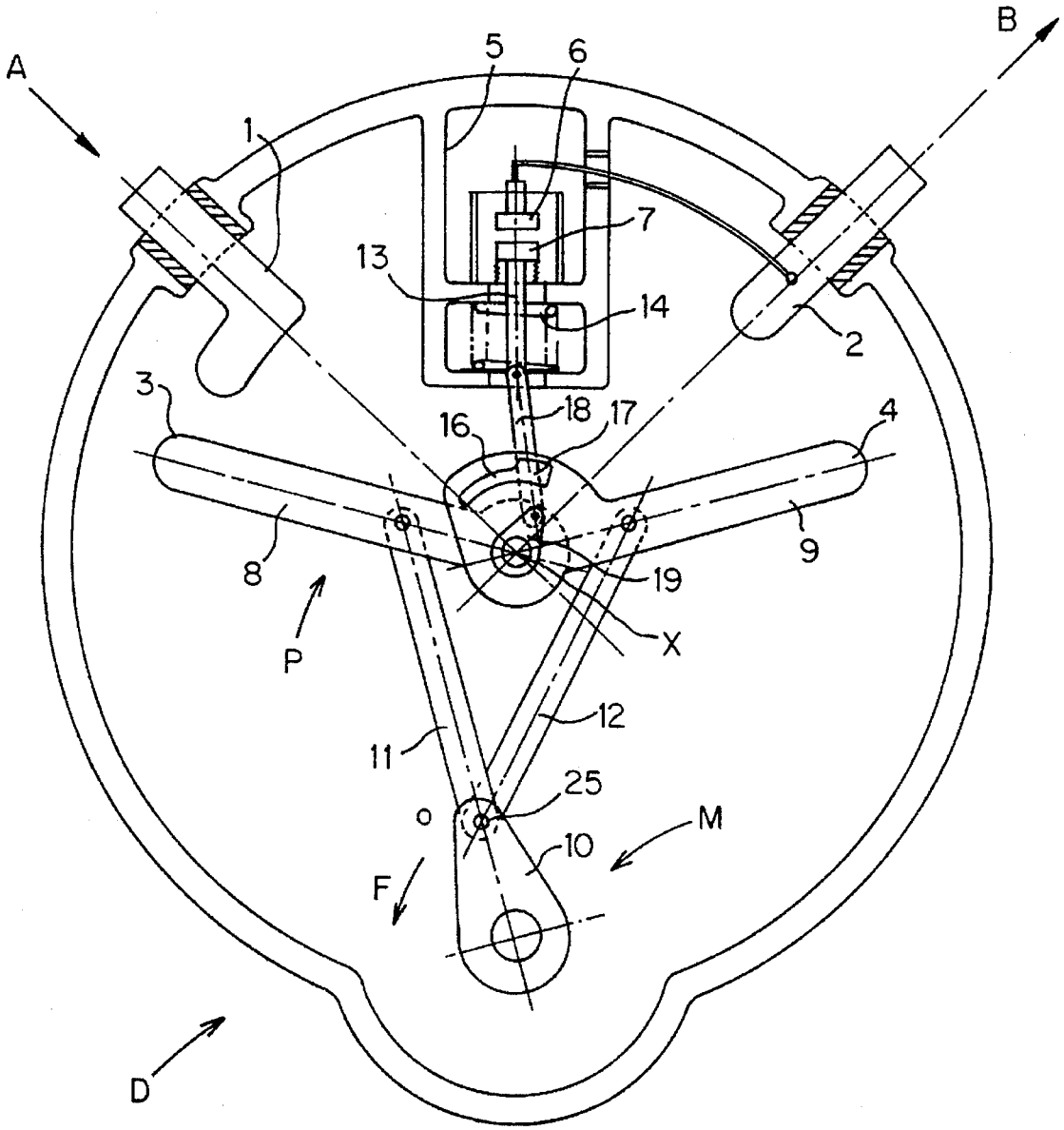

In FIG. 3, it can be seen that after an additional rotation of the operating shaft 24, having brought about a corresponding rotation of the two arms 8, 9, the third stationary and movable contacts 6, 7 of the vacuum cartridge 5 open break the electrical current between the terminals A and B. After the third stationary and movable contacts 6, 7 have opened and the current has been interrupted, the first stationary and movable contacts 1, 3 open, which contacts are fully open in FIG. 4, illustrating the circuit breaker in the fully open position.

Figure 5:
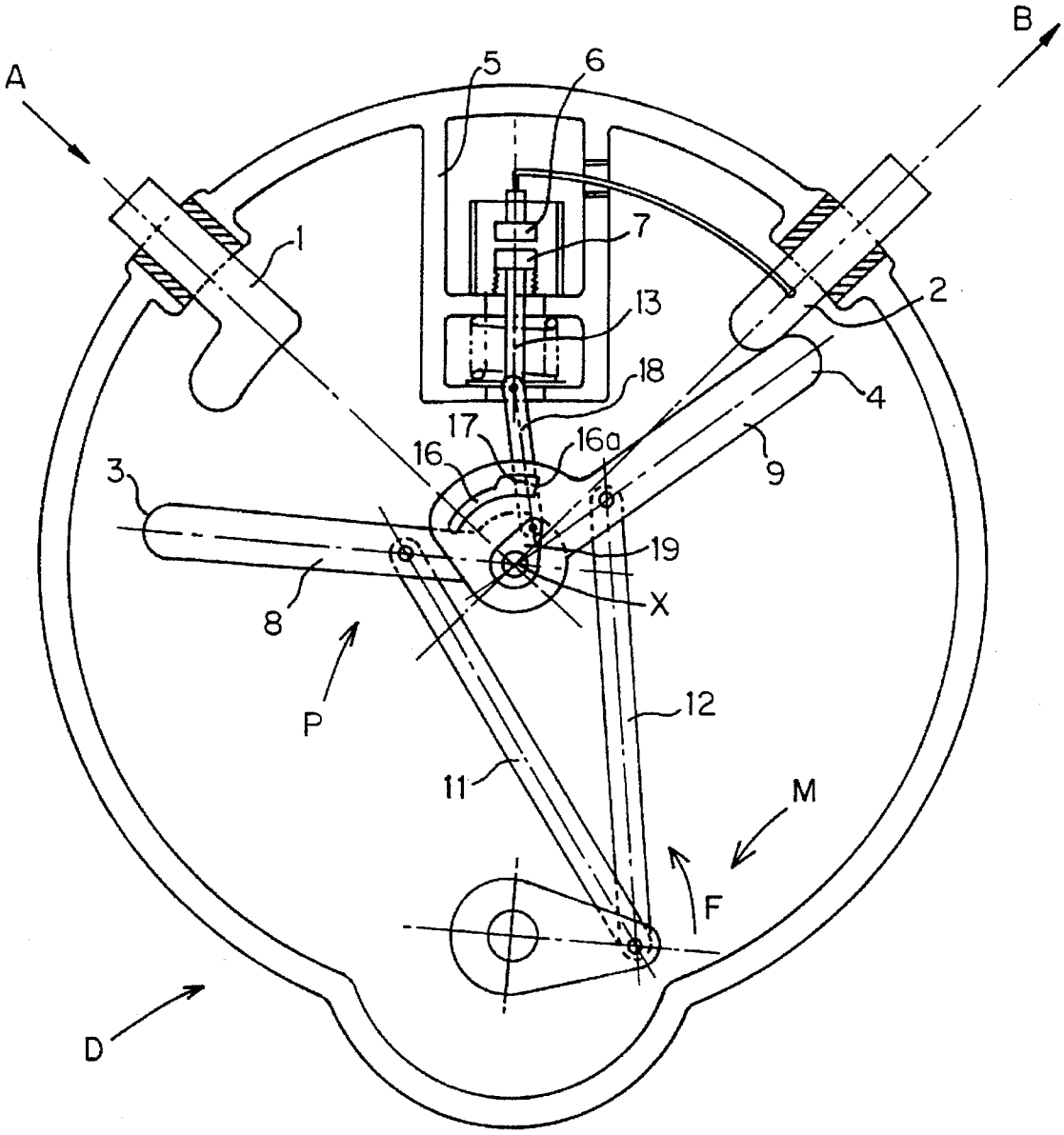
Figure 6:
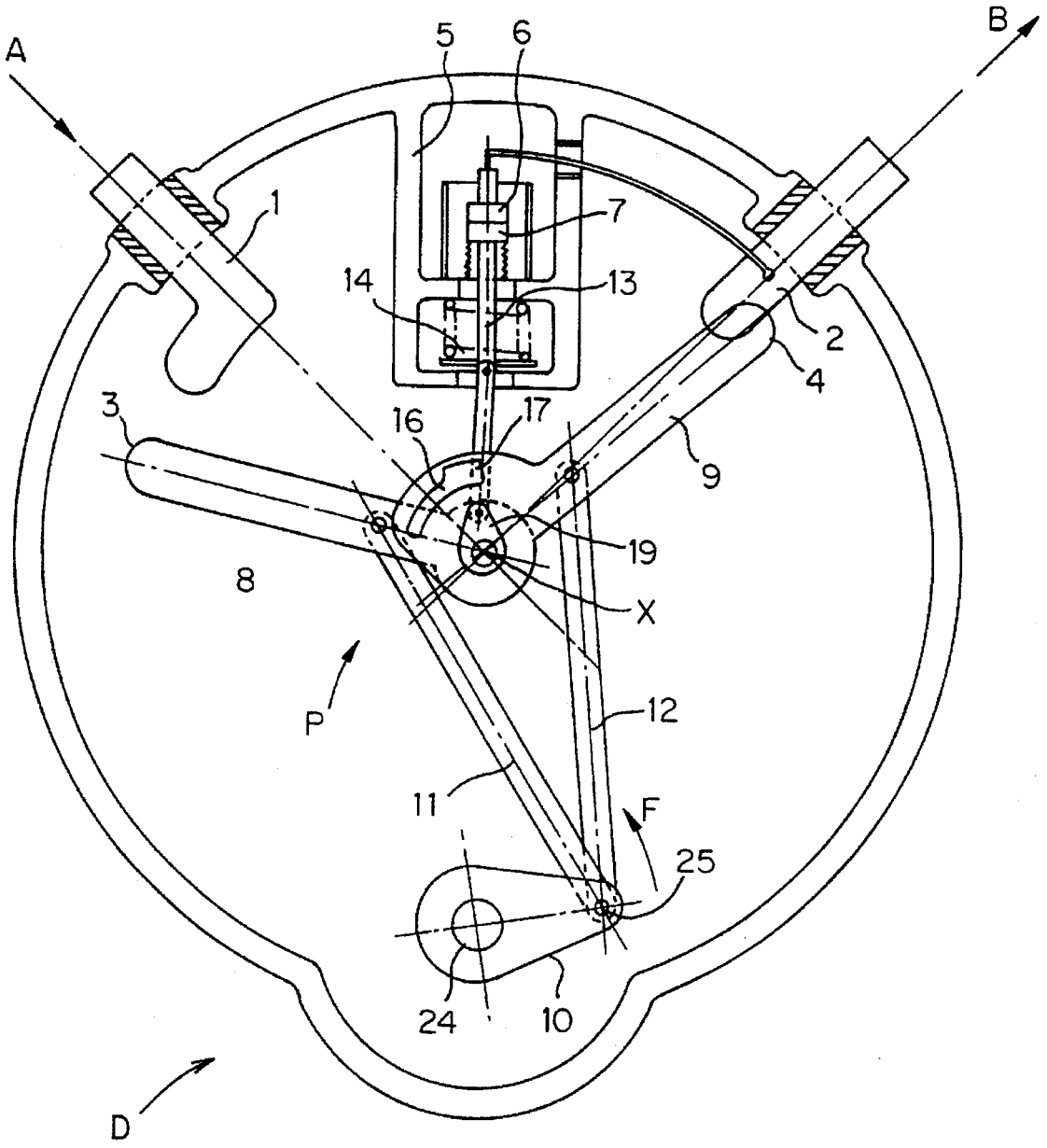
Figure 7:
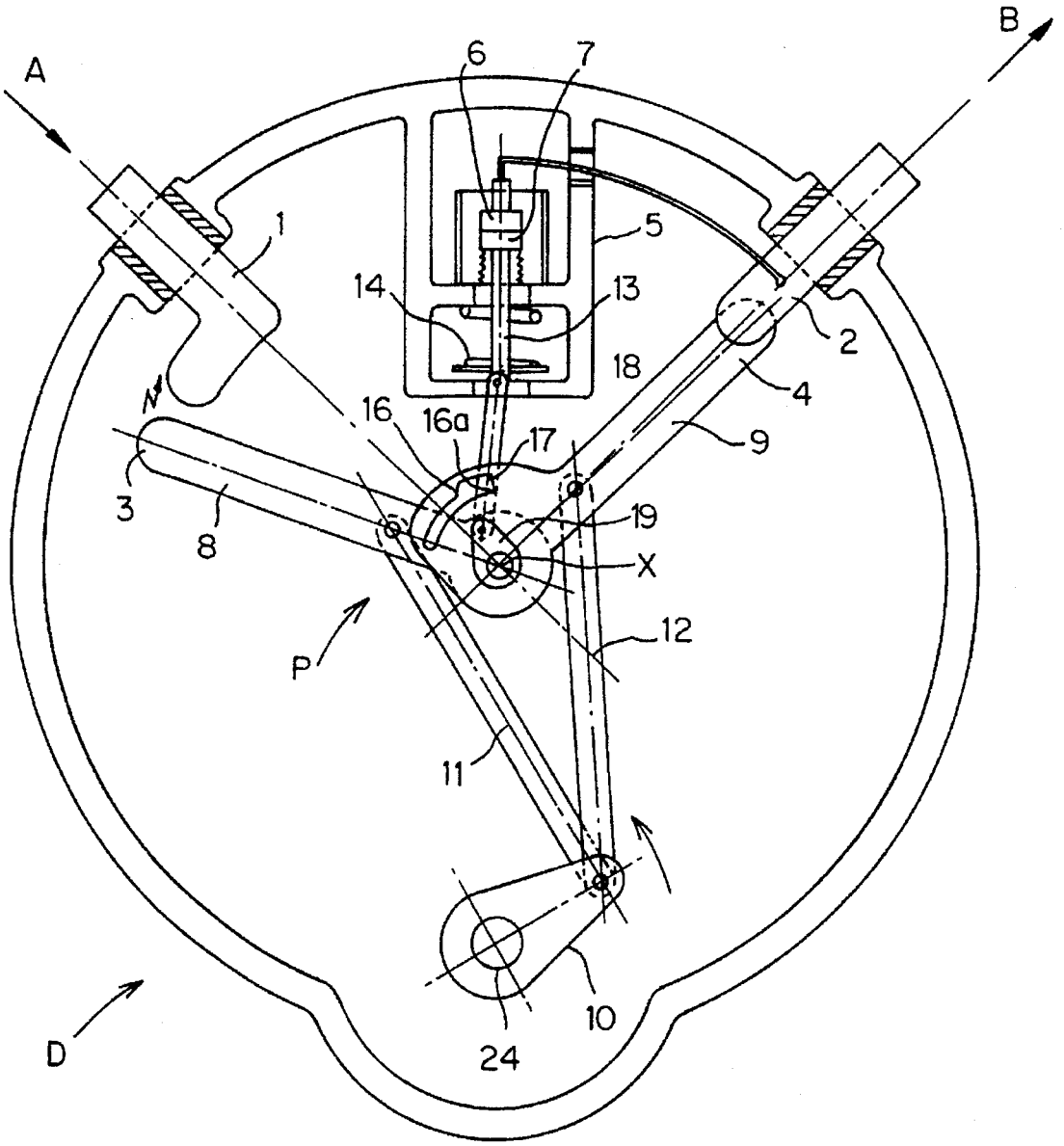
Figure 8:
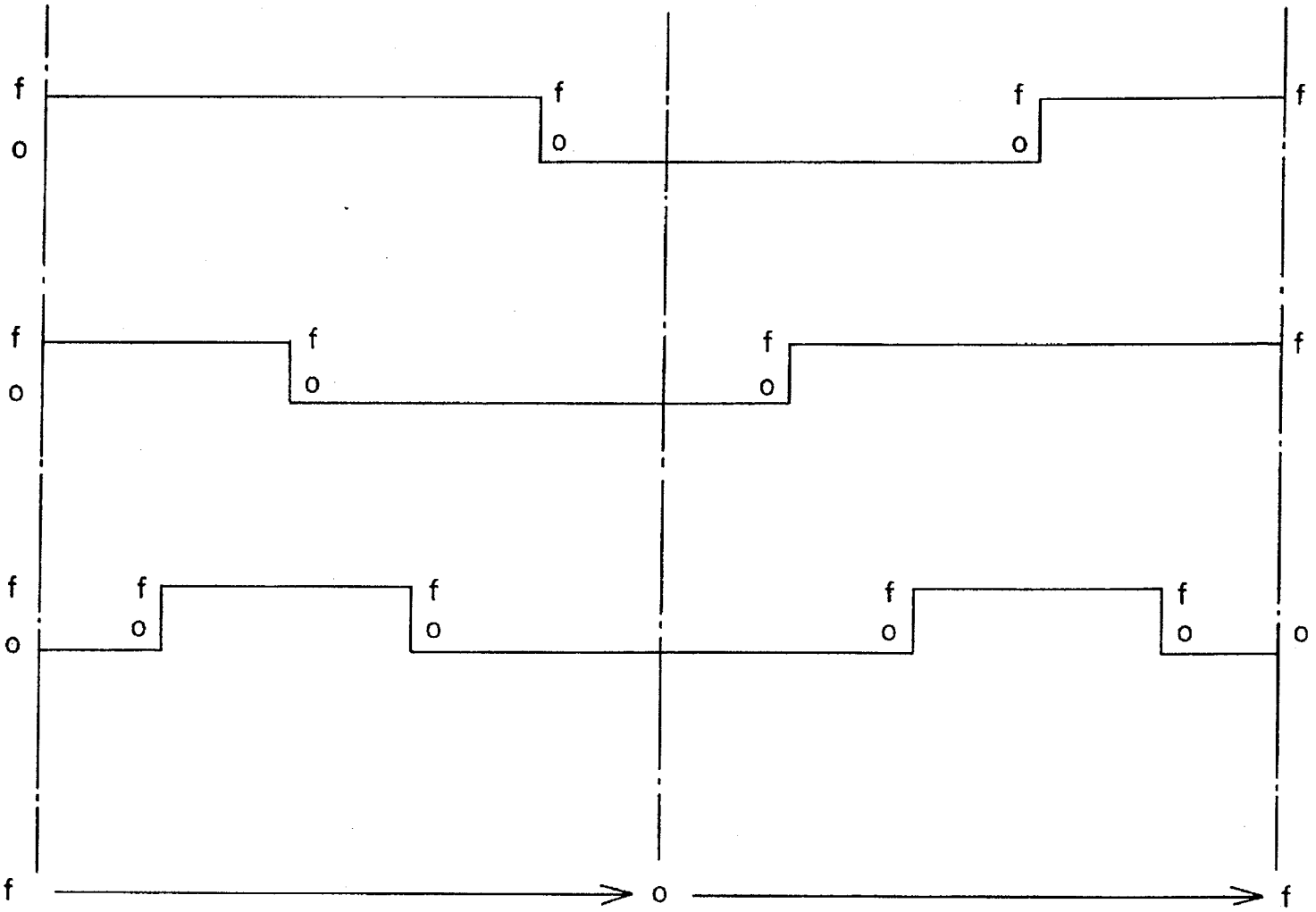
FIG. 8 illustrates an operating diagram representing the state of opening or closing of the different circuit breaker contacts, i.e. the first stationary and movable contacts, the second stationary and movable contacts, and the vacuum cartridge contacts, according to the different stages of opening and closing of the circuit breaker.

In FIG. 5, after a rotation of about three-quarters of a turn of the operating shaft 24, always in the same direction (see arrow F), the circuit breaker D is in the course of closing and the second stationary and movable contacts 2, 4 start to close. When the arm 9 rotates, the spigot 17 associated to the rod 13 is driven by the edge 16*a* of the previously mentioned aperture 16 so as to move the rod 13 upwards, and thus close the third stationary and movable contacts 6, 7 of the cartridge 5 (as represented in FIG. 6), before closing of the first stationary and movable contacts 1, 2, which enables switching of the arc associated to the first contacts 1, 3 as represented in FIG. 7. It can be noted that the closed position of the cartridge 5 when closing of the circuit breaker D takes place is maintained for a duration appreciably equal to that during which the cartridge 5 is maintained when opening of the circuit breaker D takes place. It can also be noted that the operating shaft 24 always rotates in the same direction (arrow F), both for opening and for closing of the circuit breaker D.

The relative positions of the different contacts, as described previously are illustrated particularly in FIG. 8 in which the state of the first stationary and movable contacts 1, 3 is represented in (1), the state of the second stationary and movable contacts 2, 4 in (2), the state of the contacts 6, 7 of the vacuum cartridge 5 in (3), and the state of the circuit breaker in (4).

Operation of another embodiment of the switch of the invention will now be briefly described with reference to FIGS. 9 to 15. This operation is similar to that of the circuit breaker described previously. Here, however, the operation comprises an additional earthing stage, at the end of the opening cycle, and closing of the switch I is achieved by a rotation of the operating shaft 24 in a direction opposite to that corresponding to opening.

Figure 9:
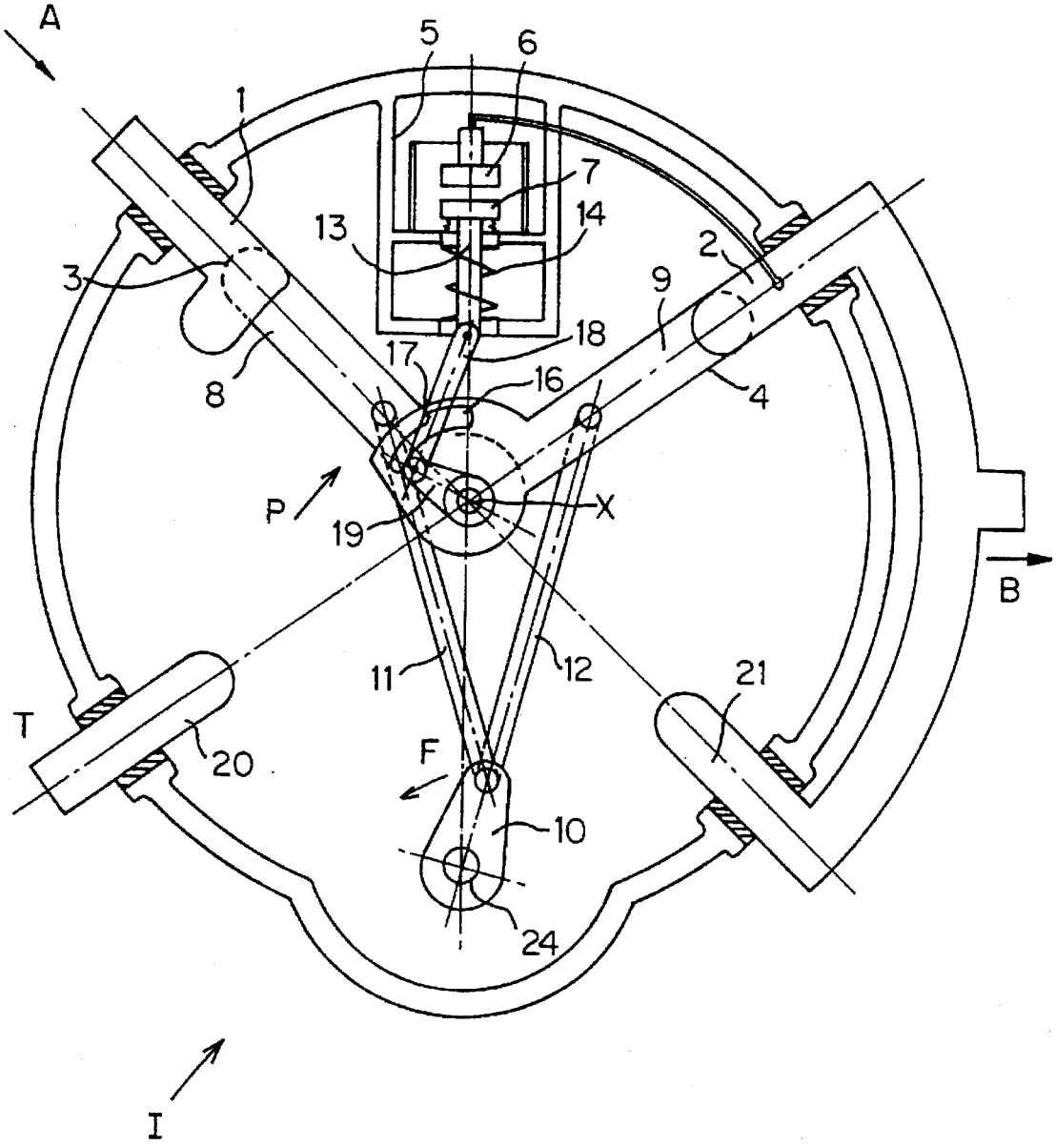
FIGS. 9 to 11 illustrate radial sectional views of a switch according to another embodiment of the invention, respectively for a closed position, for an open position, and an earthed position of the switch.
Figure 10:
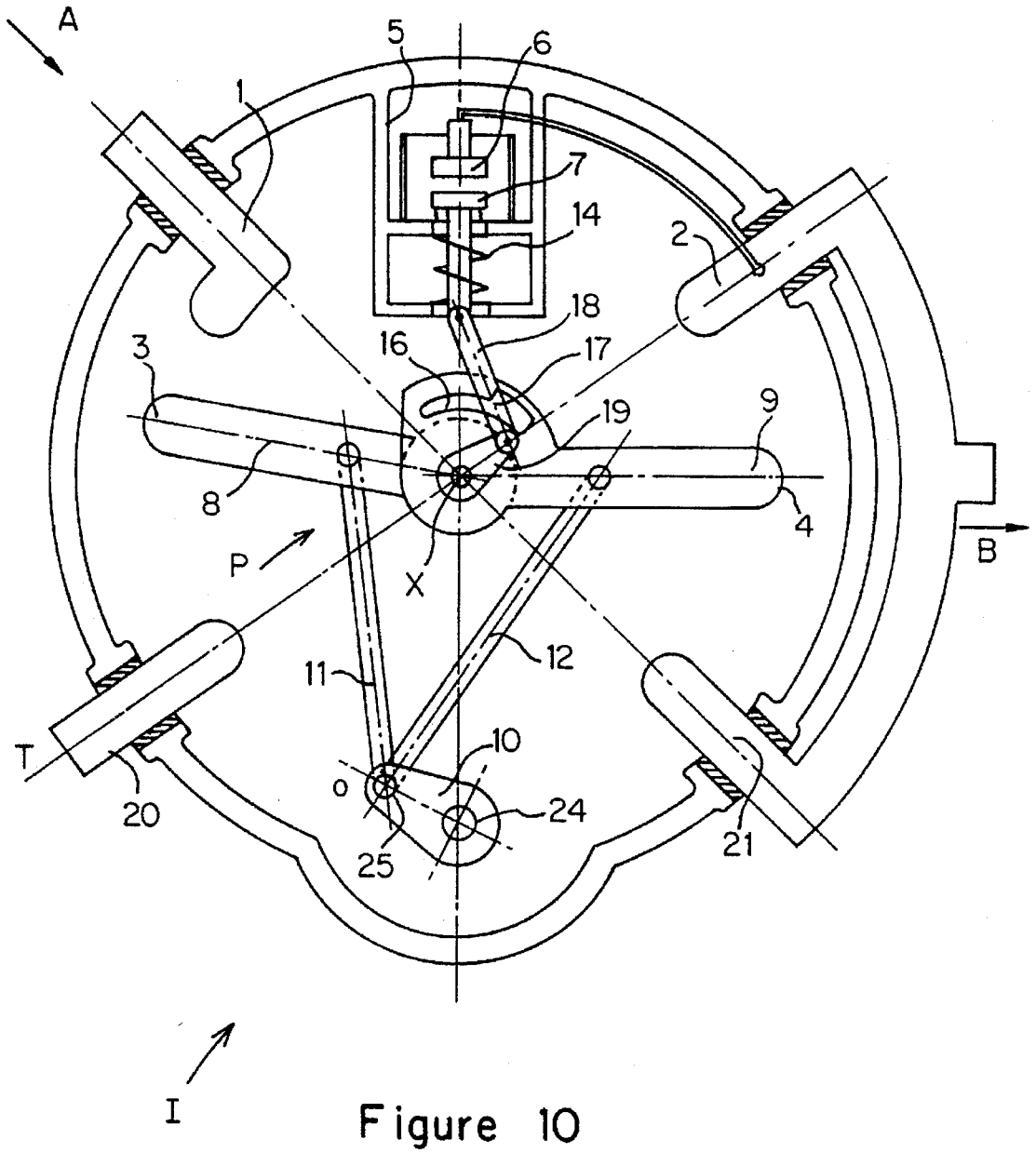

In FIG. 9, the switch I is in the fully closed position, the first and second contacts 1, 2, 3, 4 being closed, whereas the third stationary and movable contacts 6, 7 of the vacuum cartridge 5 are open. In FIG. 10, after a rotation of the operating shaft 24 in the opening direction (see arrow F in FIG. 9), the switch I is in the open position. It can be noted that the intermediate opening stages are not illustrated, as they correspond to those of the previously described circuit breaker.

Figure 11:
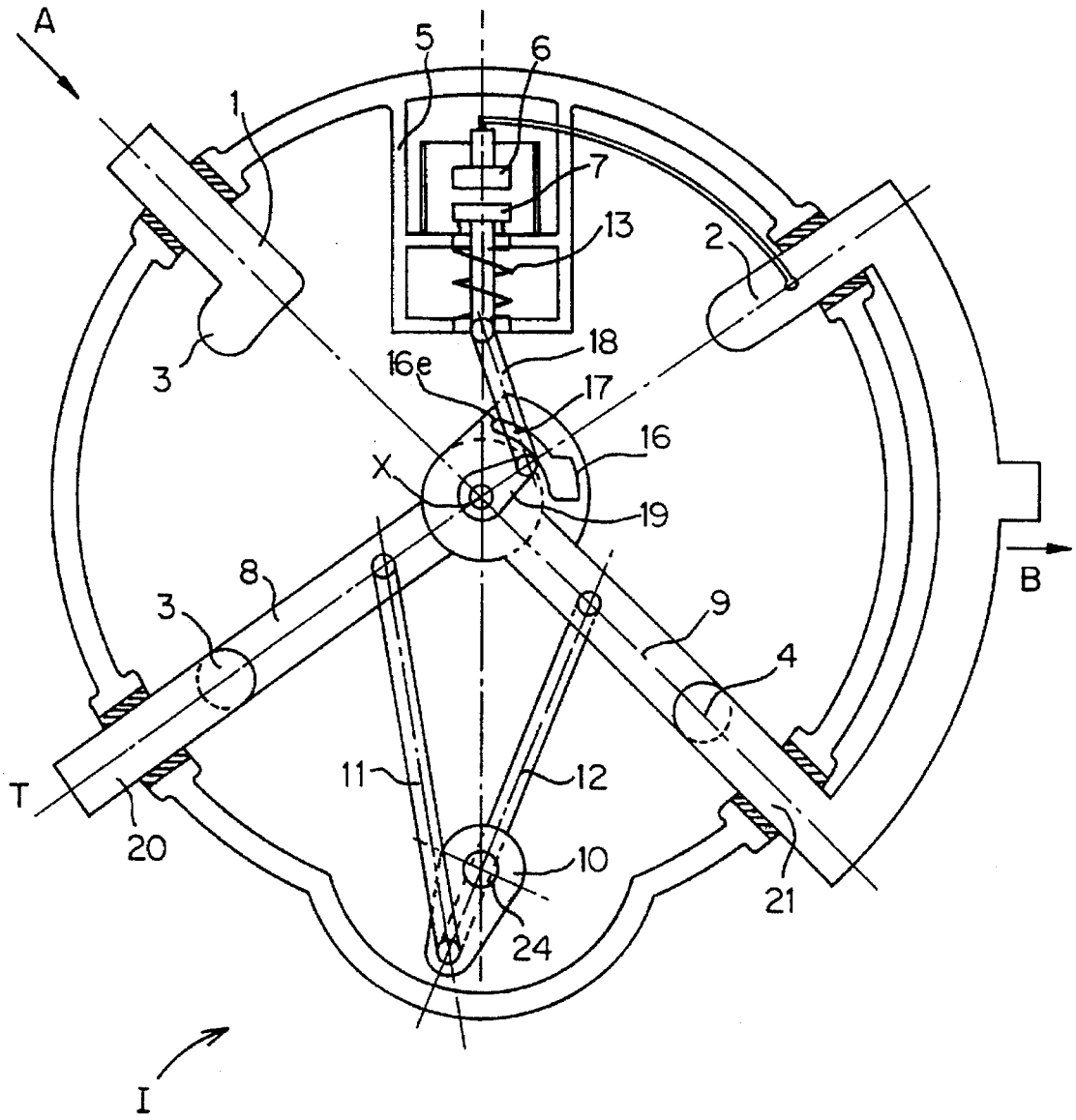

In FIG. 11, it can be seen that an additional rotation of the operating shaft 24 always in the same direction has moved the two arms 8, 9 of the conducting bridge P respectively into contact with the fourth and fifth stationary contact 20, 21. It can be noted that during this movement, the spigot 17 associated to the rod 13 has moved to the bottom 16*e* of the groove 16, the contacts of the vacuum cartridge 6, 7, remaining open. In this position of the switch, the whole of the downstream electrical circuit connected to the terminal B is connected to the earth T.

Figure 15:
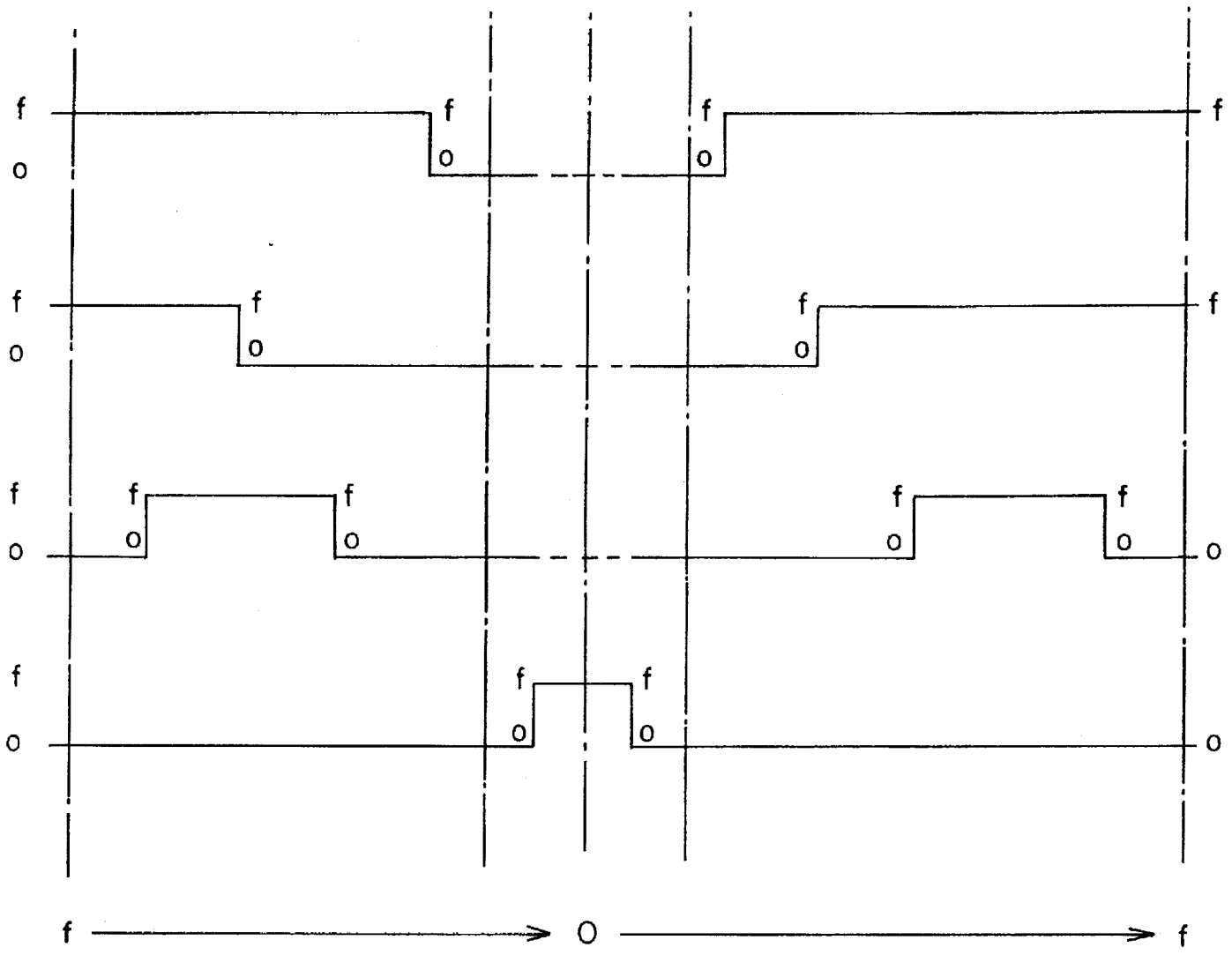
FIG. 15 illustrates an operating diagram similar to that of FIG. 8, but representing the state of the different switch contacts.

Referring to FIG. 15, it can be noted that the state of the contacts during the opening stages of the switch corresponds exactly to that of the circuit breaker D.

Figure 12:
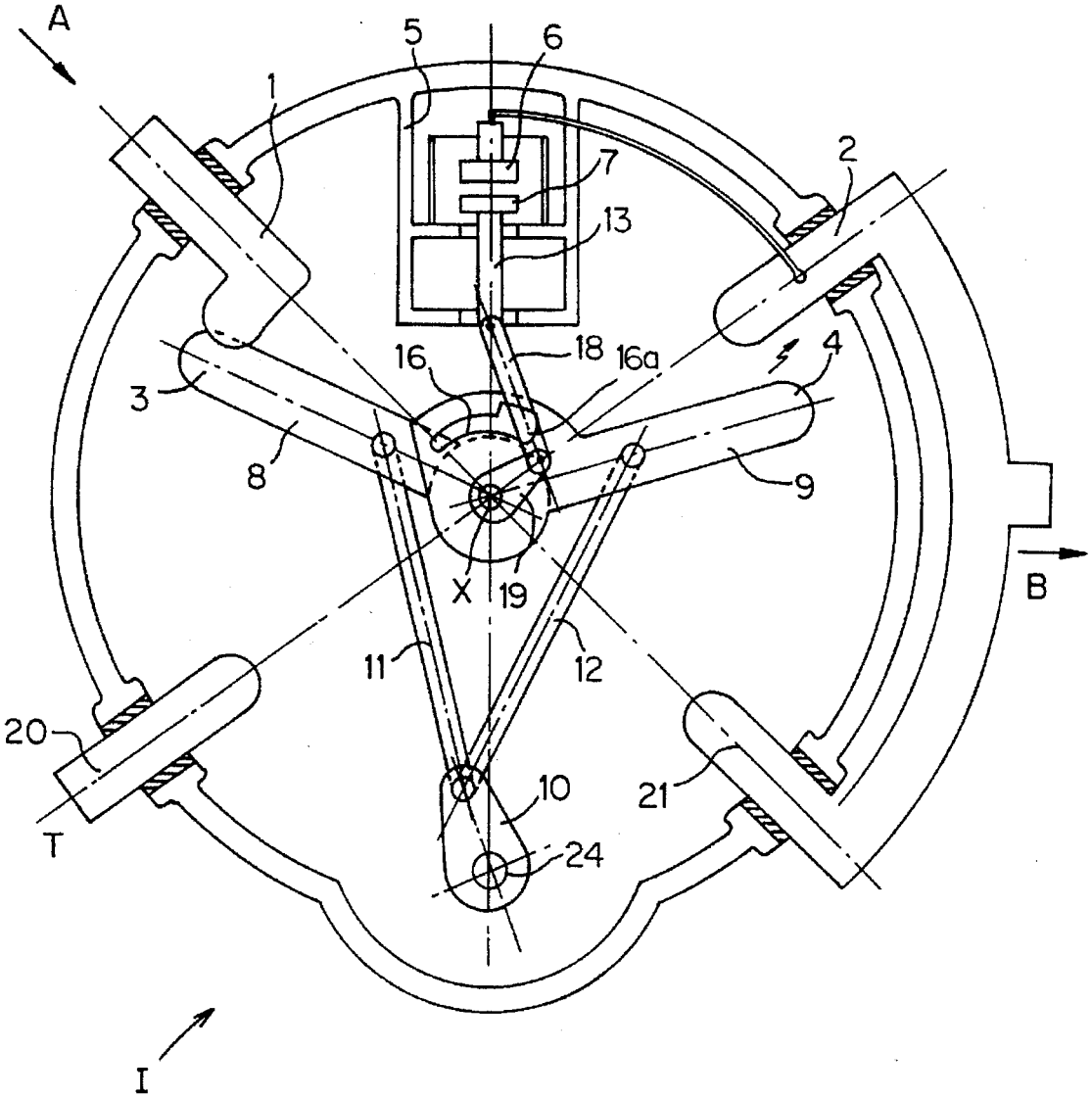
FIGS. 12 to 14 illustrate similar views of the same switch in different positions corresponding to different stages of closing.
Figure 13:
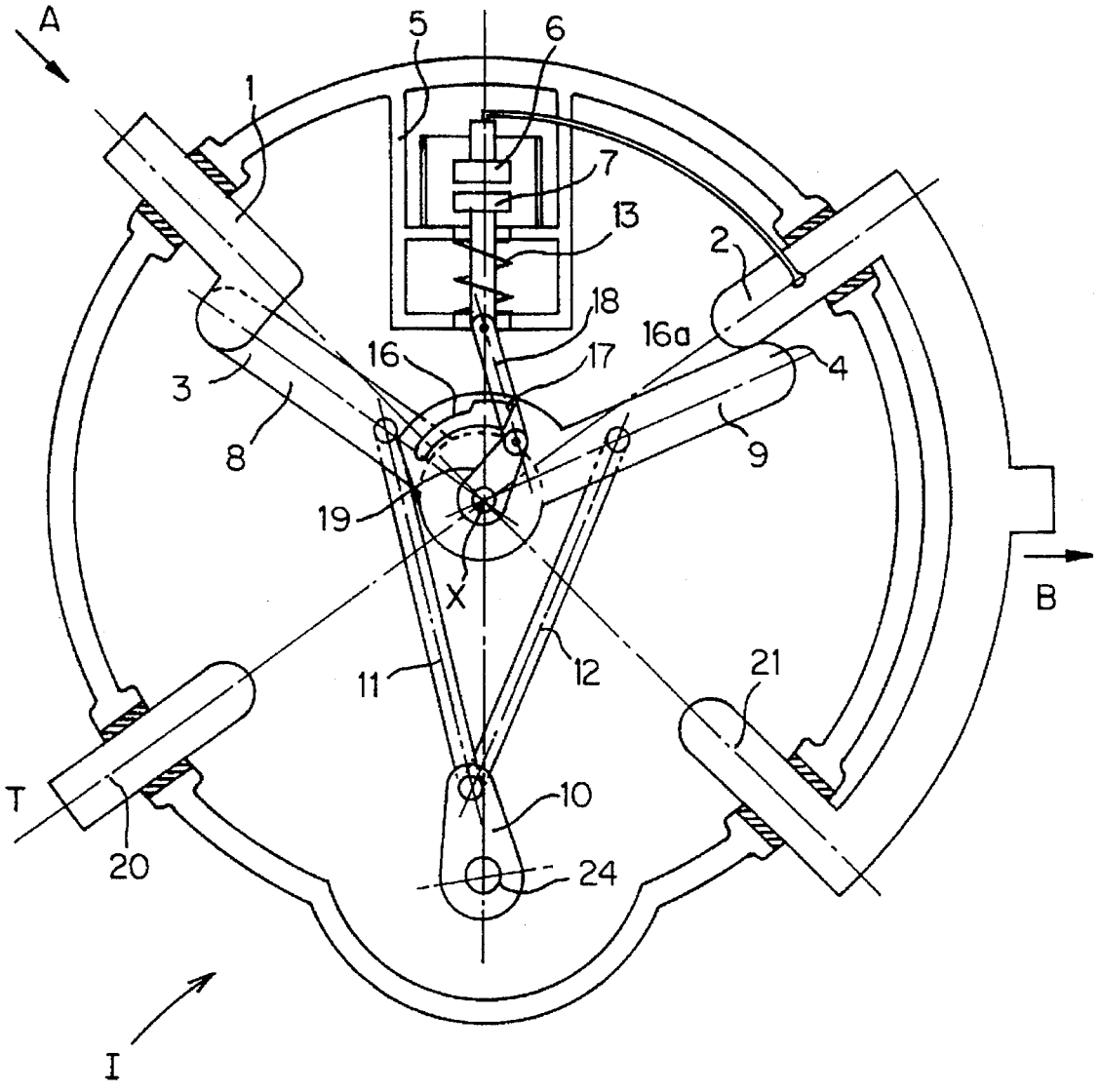
Figure 14:
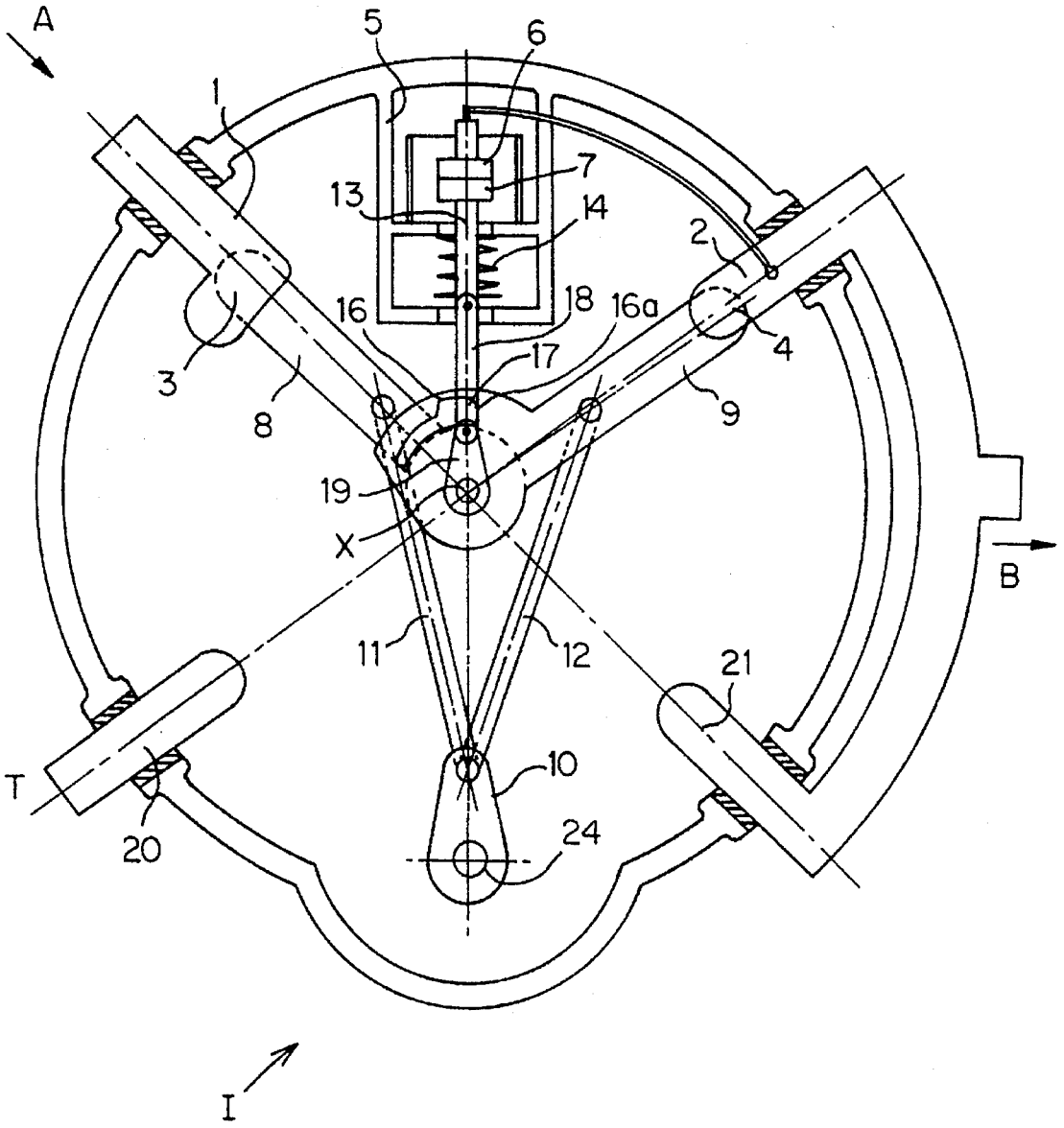

In FIG. 12, after a rotation of the operating shaft 24 in the closing direction (opposite to the opening direction), the first stationary and movable contacts 1, 3 start to close, which moves the spigot 17 towards the edge 16*a* of the aperture 16, which does not have any effect on the rod 13. In FIG. 13, contact is established between the first stationary and movable contacts 1, 3, contact between the second stationary and movable contacts 2, 4 is triggered, and second arm 9 starts to move the rod 13 upwards by means of the edge 16*a*. After complete closing of the first and second contacts 1, 2, 3, 4, the third stationary contact and the third movable contact 6, 7 close (FIG. 14), then open again, returned automatically to the open position by the spring 14.

It can be observed that operation of the switch I, in the course of closing, is the same as that of the circuit breaker D, with the difference that in the case of the switch I, the first stationary and movable contacts 1 and 3 close prior to closing of the cartridge 5 and of the second stationary and movable contacts 2, 4.

Operation of the second embodiment of the switch I of the invention will be described hereafter, with reference to FIGS. 16 to 20 and to the operating diagram of FIG. 15 wherein the state of the first contacts 1, 3 is represented in (1), that of the second contacts 2, 4 in (2), that of the cartridge contacts 6, 7 in (3), earthing by means of closing of the contacts 3, 20 on the one hand and 4, 21 on the other hand in (4), and the state of the switch I in (5).

Figure 16:
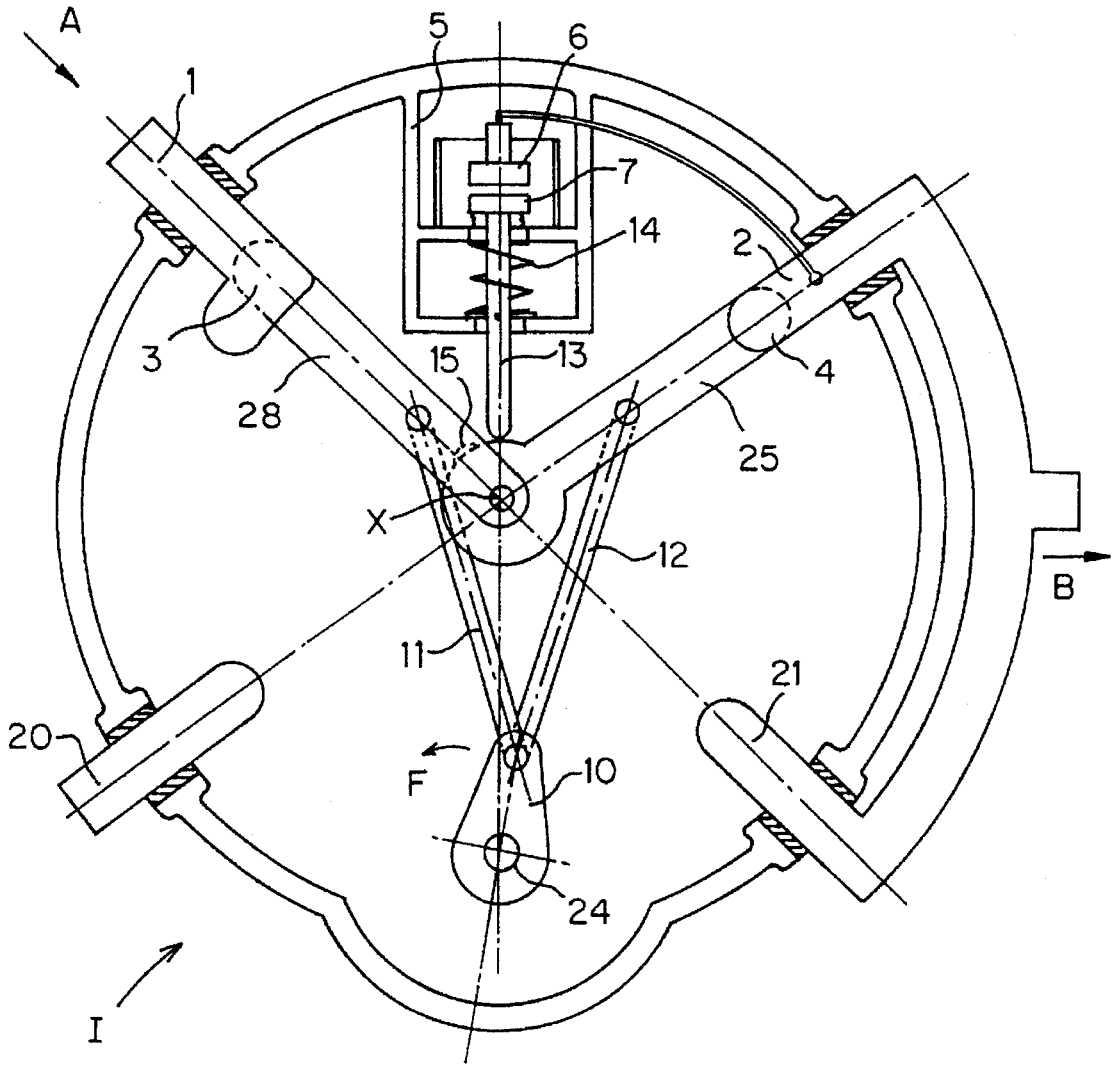
FIGS. 16 to 20 illustrate radial sectional views of a switch according to another embodiment of the invention for different positions of the switch corresponding respectively to a closed position, a beginning of opening position, an end of opening position, an open position, and an earthed position.

In FIG. 16, the switch I is in the closed position, the first and second contacts 1, 3 and 2, 4 being closed, whereas the third stationary and movable contacts 6, 7 are returned to the open position by the spring 14.

Figure 17:
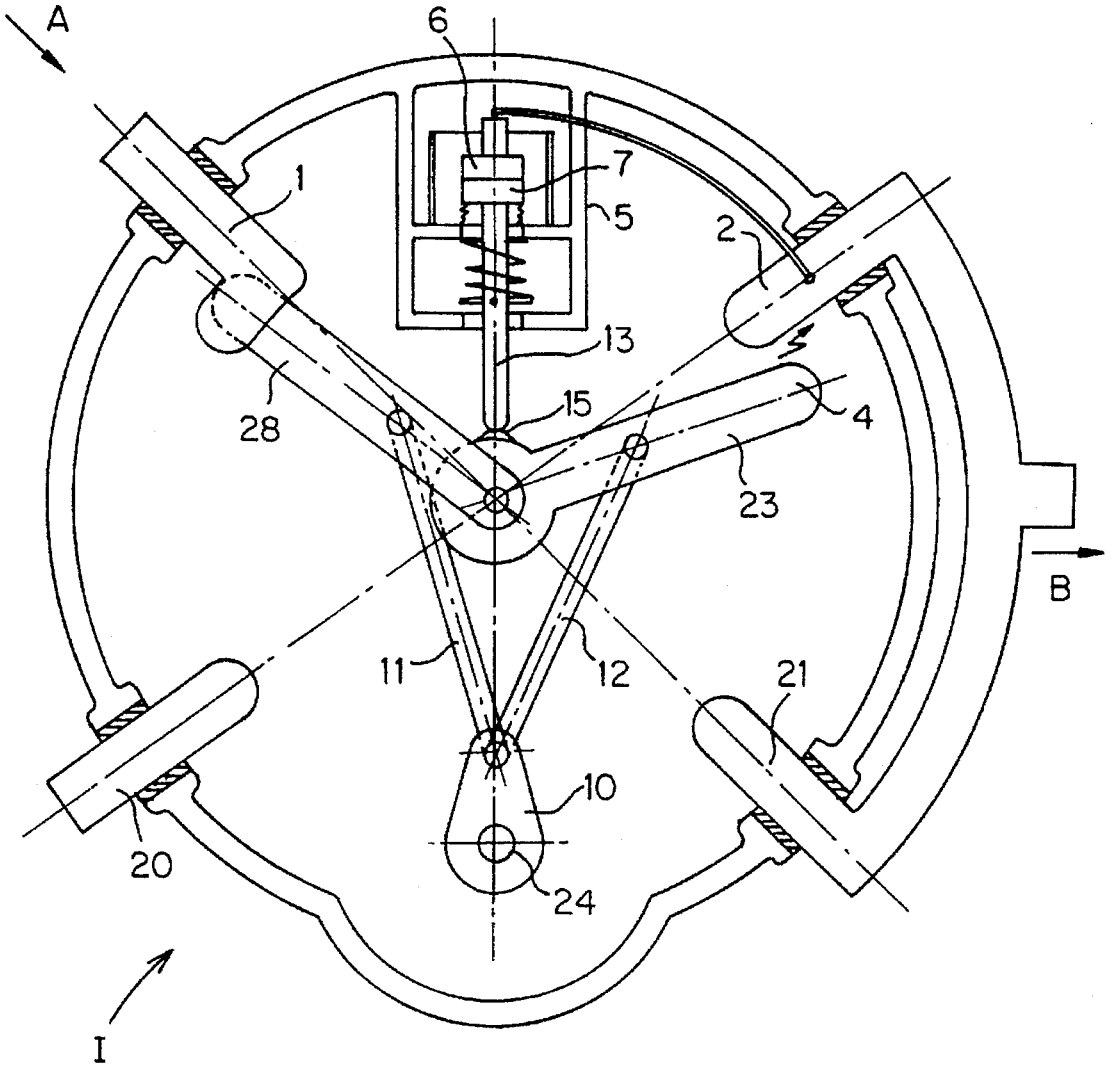
Figure 18:
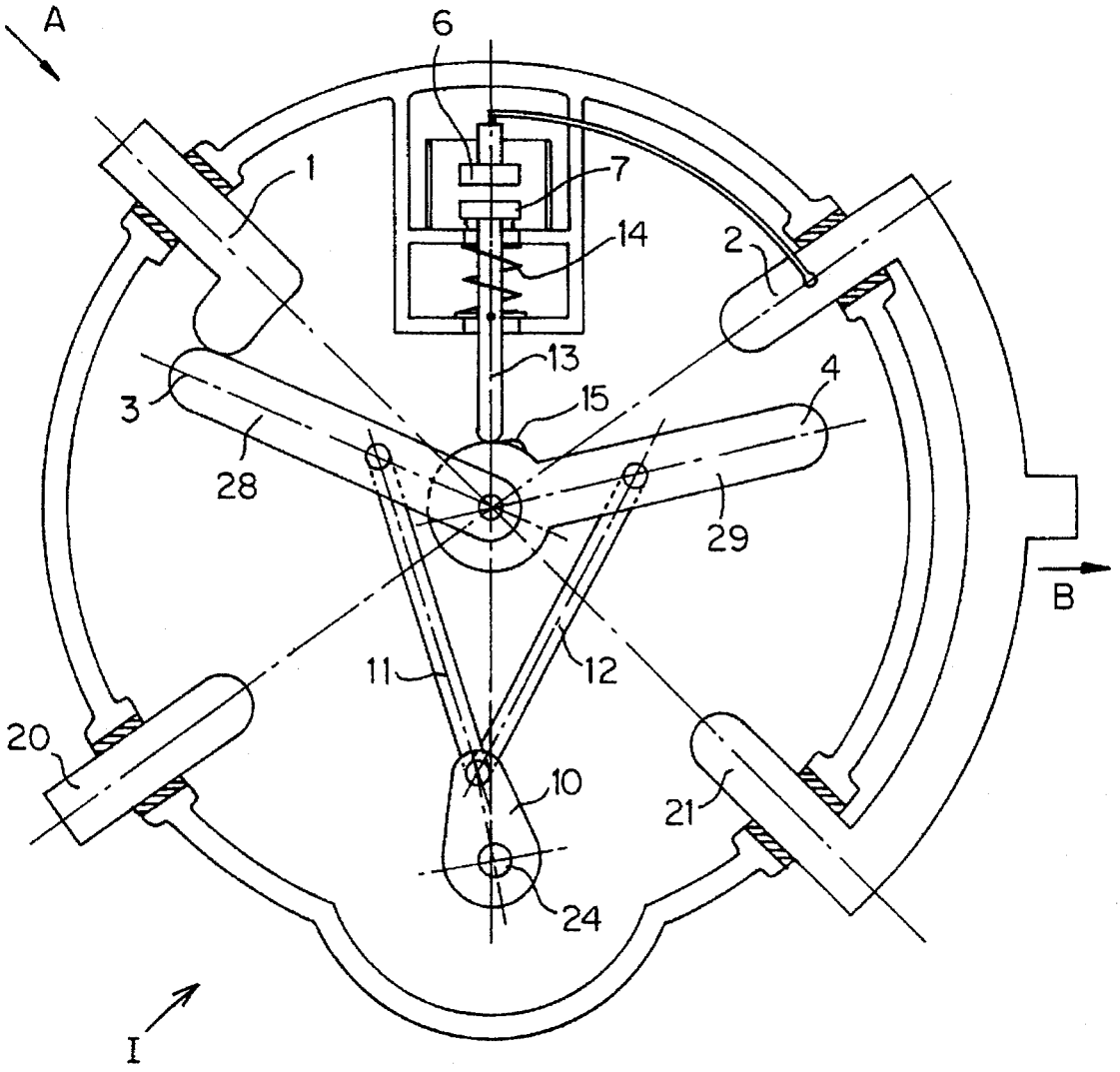

In FIG. 17, a rotation of the operating shaft 24 according to the arrow F visible in FIG. 16, has brought about an opening of the two arms 28, 29 of the bridge P, so that the first 28 of the arms 28, 29 remains in contact with the first stationary contact 1, whereas the movable contact 4 of the second arm 29 is no longer in contact with the second stationary contact 2. In the course of this rotation, and prior to opening of the second stationary and movable contacts 2, 4, the movement of the cam 15 borne by the second arm 29 causes upwards movement of the rod 13 associated with the movable contact 7 of the vacuum cartridge 5 causing closing of the third stationary and movable contacts 6, 7. After an additional rotation of the operating shaft 24, the contacts 6, of the vacuum cartridge 5 open, on account of the movement of the cam 15 and the return action of the spring 14, and the second contacts 2, 4 open wider whereas the first contacts 1, 3 start to open.

Figure 19:
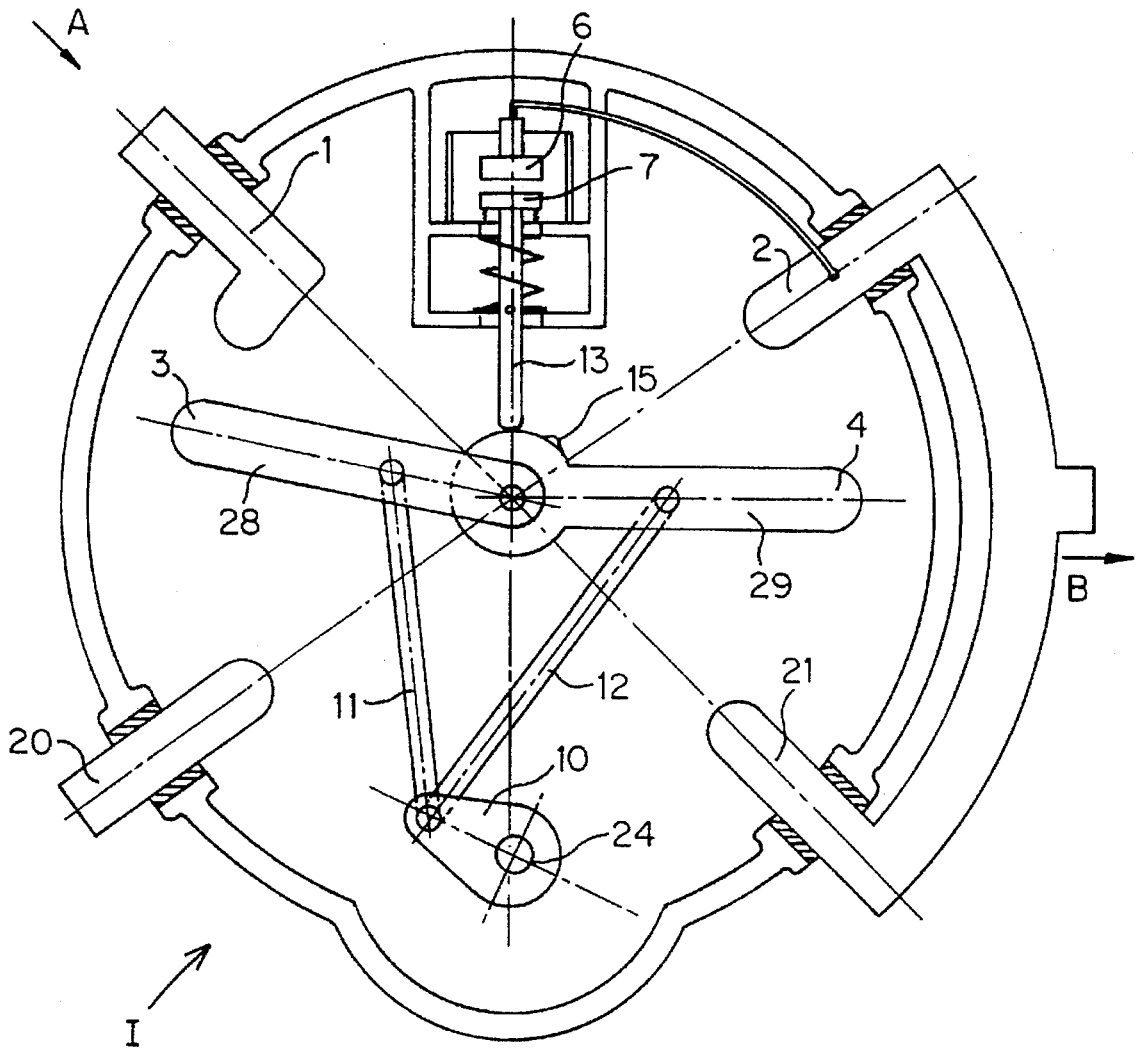
Figure 20:
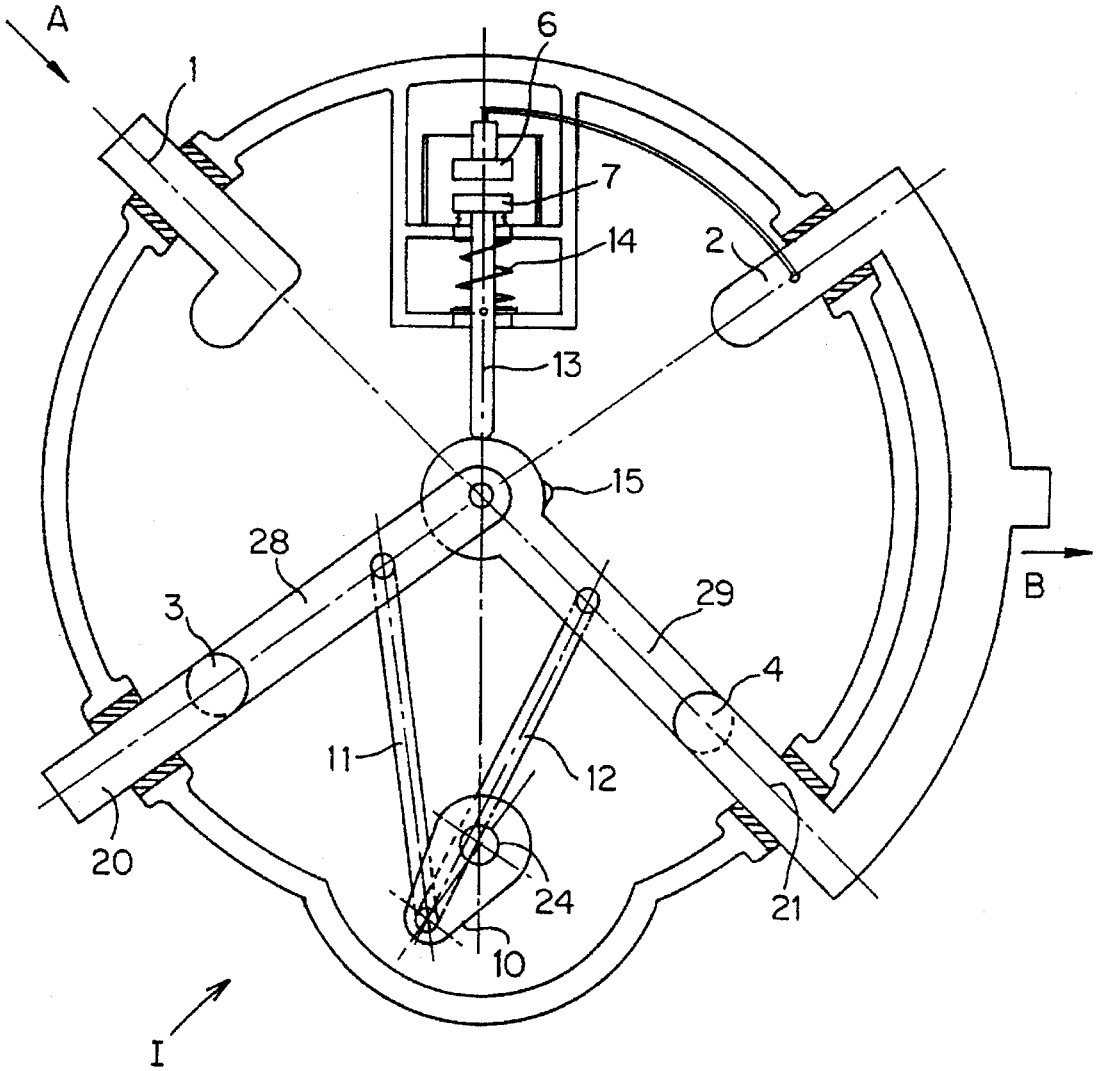

In FIG. 19, all the contacts are open, which brings the switch I to the open position. FIG. 20 illustrates the last stage of earthing. Operation of the switch I during closing being the same as that of the first embodiment described, these closing stages will not be described.

The different opening stages of the circuit breaker D according to the embodiment described in FIGS. 21 to 21*c* are finally described briefly. In FIG. 21 the circuit breaker D is in the closed position, its stationary and movable contacts being closed. In FIG. 21*a*, the contacts 6, 7 of the vacuum cartridge 5 close and the second stationary contact 2 and movable contact 4 open, the first contacts 1, 3 remaining closed. In FIG. 21*b*, the contacts 6, 7 of the vacuum cartridge 5 open, achieving breaking, then the first contacts 1, 3 open. And in FIG. 21*c* all the contacts are open.

A circuit breaker and a switch of simple design and small dimensions has therefore been achieved by means of the invention, due on the one hand to the fact that the different commands are performed by a single control part, and on the other hand that the structure of the switch enables a vacuum cartridge of small size to be used, due to the fact that the time during which it holds the permanent current is very short.

Naturally, the invention is not limited to the embodiments described and illustrated which have been given as examples only.

The use of a monobloc conducting bridge mobile in translation rather than a rotating bridge could thus be envisaged.

On the contrary, the invention comprises all the technical equivalences of the means described as well as the combinations thereof, if these are achieved according to the spirit of the invention.

We claim:

1. A medium voltage electric switch, comprising:

a sealed enclosure filled with a dielectric gas in which there are housed a first stationary contact electrically connected to a first connection terminal, a second stationary contact electrically connected to a second connection terminal, a mobile conducting bridge equipped with first and second movable contacts designed to cooperate respectively with the first and second stationary contacts and an operating mechanism coupled to said bridge to establish or interrupt the electrical circuit between the first and second connection terminals, said switch further comprising a vacuum cartridge containing a third stationary contact electrically connected to one of the first and second connection terminals, and a third movable contact electrically connected to said bridge at an intermediate point situated between the first and second movable contacts and mechanically coupled to said operating mechanism, and sequencing means designed to establish the opening and closing sequences of the first, second and third movable contacts associated with the first, second and third stationary contacts, cooperating with said operating means, in such a way that in the stable open or closed positions of the switch, the third stationary and movable contacts are separated, and that in the course of opening or closing operations of the switch, the third stationary and movable contacts close momentarily to switch the arc associated with the first stationary and movable contacts or with the second stationary and movable contacts.

2. The switch according to claim 1, wherein said bridge is rotary.

3. The switch according to claim 1, wherein said bridge comprises two distinct opposite arms, a first of said two distinct opposite arms includes an end equipped with said first movable contact and a second end pivotally mounted around a spindle, and a second of said two distinct opposite arms includes an end equipped with said second movable contact and a second end pivotally mounted around said spindle.

4. The switch according to claim 3, wherein said operating mechanism comprises a crank linked in rotation to a drive shaft, and first and second connecting rods, each of said connecting rods is coupled by one end to the crank and by another end respectively to the first and second arms.

5. The switch according to claim 1, wherein the first terminal is an input terminal strip and the second terminal is an output terminal strip.

6. The switch according to claim 1, wherein the sequencing means maintain the third stationary and movable contacts separated in the stable position of the switch, and close the third stationary and movable contacts in the course of opening the switch, prior to separation of the second stationary and movable contacts, and, in the course of closing the switch, after closing of the second stationary and movable contacts.

7. The switch according to claim 1, wherein said sequencing means include an extended fixed terminal strip provided on the first stationary contact, remaining in contact with said first movable contact over a preset travel of said first movable contact, and a reduced stationary terminal strip provided on the second stationary contact and not remaining in contact with said second movable contact oven a preset travel of the said second movable contact, when movement of the second movable contact takes place.

8. The switch according to claim 3, wherein the third movable contact is supported by a rod movable in translation which is biased by spring means in the opening direction of the third stationary and movable contacts, said rod cooperating with means provided on the arms defining the opening and closing sequencing of the third stationary and movable contacts.

9. The switch according to claim 8, wherein the means defining the opening and closing sequencing comprise at least one cam securedly united to the first or second arm in which a profile of the cam defines the sequencing.

10. The switch according to claim 8, wherein the means defining the opening and closing sequencing comprise an aperture arranged in one of the arms cooperating with a spigot securedly united to a connecting rod connected in articulated manner via one end to the rod supporting said third movable contact, and via another end to a crank mounted free in rotation on the spindle.

11. The switch according to claim 10, wherein the aperture is of arched shape and comprises a notched recess to form two portions of said aperture of different widths.

12. The switch according to claim 3, further comprising a fourth stationary contact which is connected to the earth, which is diametrically opposite to the second stationary contact with respect to said spindle and a fifth stationary contact electrically connected to said second terminal which is diametrically opposite to the first stationary contact with respect to said spindle, said fourth and fifth stationary contacts cooperating respectively with the first and second movable contacts in an earthed position of the switch.

* * * * *